US005450844A

United States Patent [19]

Kolbe et al.

[11] Patent Number: 5,450,844

[45] Date of Patent: Sep. 19, 1995

[54] LOCKING DEVICE FOR THE CONTAINER OF A GAS MASK AND BREATHING EQUIPMENT

[75] Inventors: Günther Kolbe, Mölin; Stephan Melzer; Hasso Weinmann, both of Lübeck; Wolfgang Drews, Zarpen, all of Germany

[73] Assignee: Drägerwerk AG, Lubeck, Germany

[21] Appl. No.: 112,104

[22] Filed: Aug. 26, 1993

[30] Foreign Application Priority Data

Nov. 26, 1992 [DE] Germany ..... 42 39 766.9

[51] Int. Cl.[6] ..... A62B 7/10

[52] U.S. Cl. ..... 128/206.21; 128/205.27; 128/206.17; 220/321

[58] Field of Search ..... 220/320, 321; 128/206.17, 206.12, 206.16, 206.21, 200.24, 205.27, 205.28, 205.29

[56] References Cited

U.S. PATENT DOCUMENTS

| | | | |
|---|---|---|---|
| 2,075,383 | 3/1937 | Vaughn | 220/321 |
| 2,191,975 | 2/1940 | Stephens | 220/321 |
| 2,505,173 | 4/1950 | Conley | 128/206.17 X |
| 3,246,793 | 4/1966 | Wade | 220/321 |
| 3,848,768 | 11/1974 | Griffin | 220/321 X |
| 4,347,944 | 9/1982 | Moldrup | 220/320 |
| 5,065,892 | 11/1991 | Lukez | 220/320 X |
| 5,226,412 | 7/1993 | Winters | 128/206.12 |

FOREIGN PATENT DOCUMENTS

| | | | |
|---|---|---|---|
| 150506 | 4/1936 | Australia | 128/206.17 |
| 623153 | 12/1935 | Germany . | |
| 1039368 | 3/1959 | Germany . | |
| 2007665 | 9/1971 | Germany | 128/209.27 |
| 2908602 | 9/1980 | Germany | 220/321 |
| 3639421 | 5/1988 | Germany . | |
| 2223683 | 4/1990 | United Kingdom | 128/205.29 |

*Primary Examiner*—Edgar S. Burr
*Assistant Examiner*—Eric P. Raciti
*Attorney, Agent, or Firm*—McGlew and Tuttle

[57] ABSTRACT

A container and locking device for gas tightly locking a container for gas masks and breathing equipment containing moisture-sensitive filter mass, including a first container shell and a second container shell, each container shell having outwardly projecting circumferential edges at front surfaces, the first container shell and the second container shell abutting at the front surfaces. A strap surrounding the projecting circumferential edges to clamp the circumferential edges. A sealing member connecting the first container shell and the second container shell, the sealing member being inserted into grooves located at the front surfaces of the first container shell and the second container shell. A lock connected to the strap ends for holding the strap ends, the lock being pivotable for pivoting movement around at least one hinge located at one of the first container shell and the second container shell, the lock including a tumbler participating in the pivoting movement and a transmission member participating in the pivoting movement, the tumbler moving from a closed position engaging the strap ends to a release position for releasing the strap ends upon the pivoting movement, the transmission member acting on the first container shell and the second container shell to move the first container shell and the second container shell relative to increase a distance between the front surfaces.

7 Claims, 3 Drawing Sheets

LOCKING DEVICE FOR THE CONTAINER OF A GAS MASK AND BREATHING EQUIPMENT

FIELD OF THE INVENTION

The present invention pertains to a locking device for gas-tightly locking a container for gas masks and breathing equipment with moisture-sensitive filter mass, which includes consists of two container shells abutting at front surfaces, with circumferential edges projecting to the outside at the front surfaces, and with a strap surrounding the edges in the manner of a clamp, with a lock uniting the ends of the strap, and with a sealing element, which connects the container shells and is inserted into grooves located at the front surfaces of the container shells.

BACKGROUND OF THE INVENTION

A locking device of this type has become known from German Patent DE-PS 10 39 368. The prior-art locking device is arranged on a container of a respirator, which container consists of two container shells, and the container shells are designed as groove-like, double-walled shells at their front surfaces for accommodating a sealing material connecting the container shells to one another. To stabilize the sealing area, edges, which project to the outside and are surrounded by a clamp-like strap with a lock, are provided at the front surfaces of each container shell. To open the container, the strap is removed from the edges by pulling the lock, and the sealing material is severed at the same time with a tear wire. The gas mask and breathing equipment can then be removed from the container.

One disadvantage of the prior-art locking device is the fact that the sealing material is destroyed during the opening of the container, which makes handling difficult in those cases in which the container must be opened only briefly for testing purposes. In addition, valuable time is lost in the case of use due to the fact that the strap must first be bent off from the edges and the tear wire must be pulled off all around the edges.

A locking device for a portable container, which consists of two shells and in which the shells are held together by straps arranged in a star-shaped pattern, has become known from DE-A 36,39,421. A uniform sealing pressure is exerted by the straps on a sealing ring, which is located between the front surfaces of the container and lies flatly on the front surfaces. The strap design is very complicated for achieving a uniform contact pressure on the sealing ring.

German Patent DE-PS 623 153 discloses a container with a cover for a breathing mask, which cover is pivotable around a hinge and uses a cover lock in such a way that the cover is raised during opening. Such a lock cannot be used for containers with long sealing areas, because the locking forces act only at two points, namely, that of the lock and that of the hinge, and in the other areas there is a risk that the container will leak due to lack of contact pressure on the seal.

SUMMARY AND OBJECTS OF THE INVENTION

The primary object of the present invention is to improve a locking device of the class described such that the opening of a container with a sealing material connecting the container shells will be facilitated.

This object is attained by the lock being designed as a pivotable lock around at least one hinge located at one of the container shells; by the lock consisting of a tumbler participating in the pivoting movement for the strap ends and of a transmission member, which is likewise coupled with the pivoting movement; by the strap ends being released during the pivoting movement of the tumbler from the closed position; and by the container shells being actuated during the pivoting movement of the transmission member by performing a lifting movement in such a way that the distance between the front surfaces will be increased.

Advantages of the present invention are essentially related to the fact that both the strap ends are released by the tumbler and the clamp-like holding together of the edges of the container shells is thus eliminated during the pivoting movement of the lock, and the transmission member belonging to the lock is actuated during the pivoting movement such that the container shells are brought into the opening position, and the sealing element is now removed at least from one of the grooves.

It is advantageous to provide the strap ends with projecting dogs, which engage the windows located in the tumbler in the closed position of the tumbler. On raising the tumbler out of the closed position, the dogs slide out of the windows, and the strap ends will be released.

A first hinge is advantageously provided between the tumbler and the transmission member, and a second hinge is provided between the transmission member and the first container shell, and the transmission member has, in the area of the second hinge, a cam-like disk, which engages a projection connected to the second container shell. The second hinge may be simply designed such that the transmission member is attached, in the manner of a ring to a hinge pin located on the second container shell, and the cam plate is made directly in one piece with the annular area of the transmission member.

The tumbler or the transmission member is advantageously provided with a deflecting means with a first control pin, wherein the deflecting means transmits the pivoting movement into a translatory movement, and the first control pin releases a belt bracket located on the container shell during the pivoting movement of the tumbler or of the transmission member.

The deflecting means is advantageously designed as a third hinge arranged on the transmission member with the lever arm "a" from the center of the second hinge.

A second control pin, which extends into fastening slots located on the second container shell, and locks a belt bracket located in the fastening slots when the container shells are united, is advantageously attached to the first container shell. The belt bracket is released during the pivoting movement of the transmission member, during which the distance between the front surfaces of the container shells is increased.

The sealing element is advantageously designed as a labyrinth seal, which has, e.g., a double-T cross-sectional contour and seals the side walls of the grooves.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENTS

Figure 1:
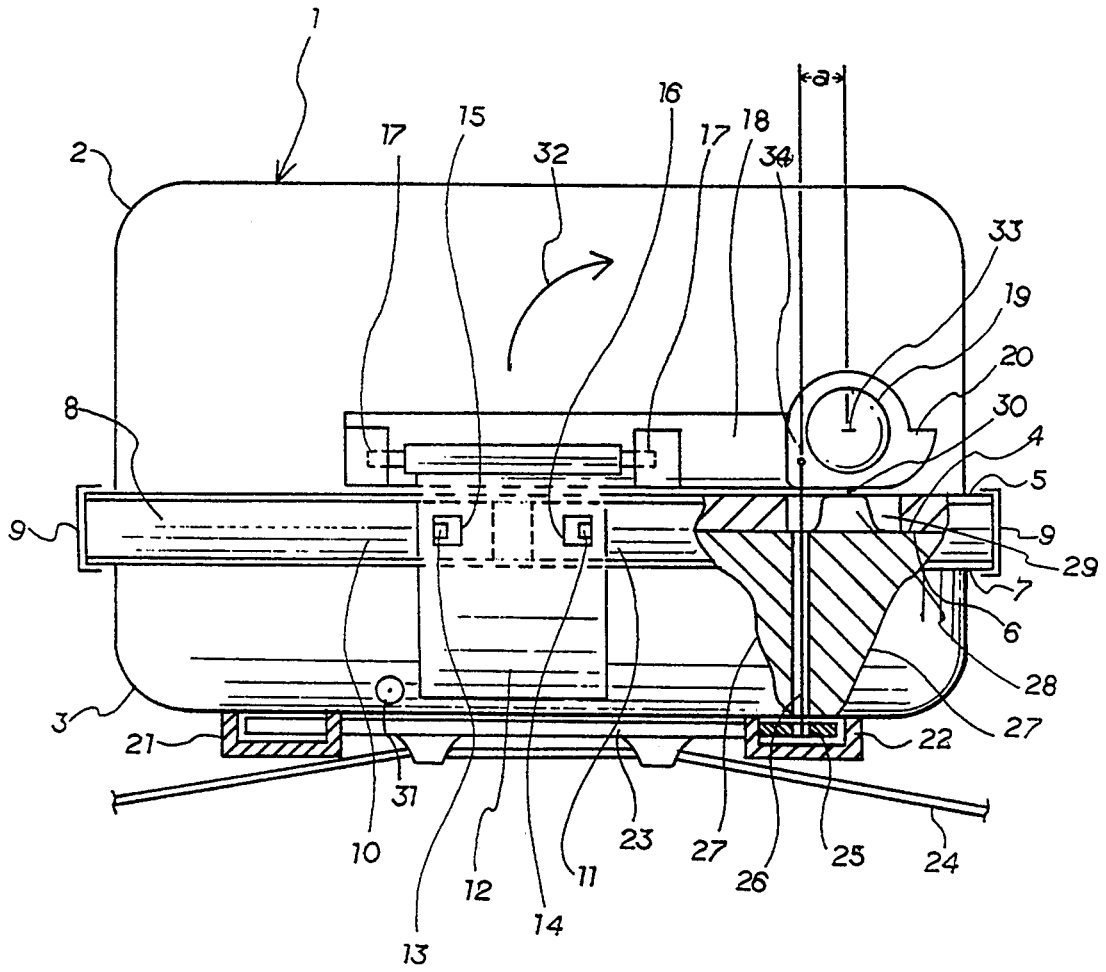
FIG. 1 is a partially sectional view showing a container for a gas mask and breathing equipment in the closed position.

FIG. 1 shows a closed container 1 for a gas mask and breathing equipment, not shown, with a first container shell 2 and a second container shell 3. The first container shell 2 has, at a first front surface 4, an outwardly projecting first edge 5, and, corresponding to this, the second container shell 3 has, at a second front surface 6, a likewise outwardly projecting second edge 7.

The container shells 2, 3 are held together by a strap 8, which has clamps 9, which surround the edges 5, 7. The strap 8 has strap ends 10, 11, which are connected to a tumbler 12 such that projecting dogs 13, 14 at the strap ends 10, 11 snap into corresponding windows 15, 16 in the tumbler 12. The tumbler 12 is rotatable around a first hinge or tumbler hinge 17, which is arranged at a transmission member 18. The transmission member 18 is pivotable around a second hinge or transmission member hinge 19, and has a cam plate 20 in the area of the second hinge 19.

Fastening slots 21, 22, into which a belt bracket 23 with a carrying belt 24 can be pushed, are arranged on the rear side of the second container shell 3.

In the area of the right-hand fastening slot 22, the belt bracket 23 has a hole 25, which is engaged by a first control pin 26 hinged to the transmission member 18, thereby locking the belt bracket 23 in the fastening slots 21, 22. For the sake of greater clarity, the container shells 2, 3 are broken open in the area of the first control pin 26 along the intersection lines 27, and the belt bracket 23 is also shown in a sectional view in the area of the hole 25.

A projection 28, which extends into an opening 29 in the first edge 5 and touches the cam plate 20 at the contact point 30, is located at the second front surface 6 of the second container shell at the level of the second hinge 19.

The container 1 is opened as follows:

The tumbler 12 is first rotated around the first hinge 17 along a first pivoting arrow 31, which is perpendicular to the drawing plane in FIG. 1, in the direction out of the drawing plane, and the dogs 13, 14 now jump out of the windows 15, 16, as a result of which the strap ends 10, 11 will be released, and the clamp 9 will separate from the edges 5, 6 of the container shells 2, 3. During the subsequent rotation of the transmission member 18 around the second hinge 19 along a second pivoting arrow 32, which is located in the drawing plane, the first control pin 26, which is connected to the cam plate 20 of the transmission member 18 via a third hinge 34, is raised, and the cam plate 20 extends into the projection 28 at the contact point 30, so that the container shells 2, 3 will open, or the distance between the front surfaces 4, 6 is increased. Since the first control pin 26 is disengaged from the hole 25 of the belt bracket 23 during the rotation of the transmission member 18, the belt bracket 23 can be removed from the fastening slots 21, 22. The lifting movement of the first control pin 26 is brought about by the third hinge 34 having a lever arm "a" from the center 33 of the second hinge 19.

Figure 2:
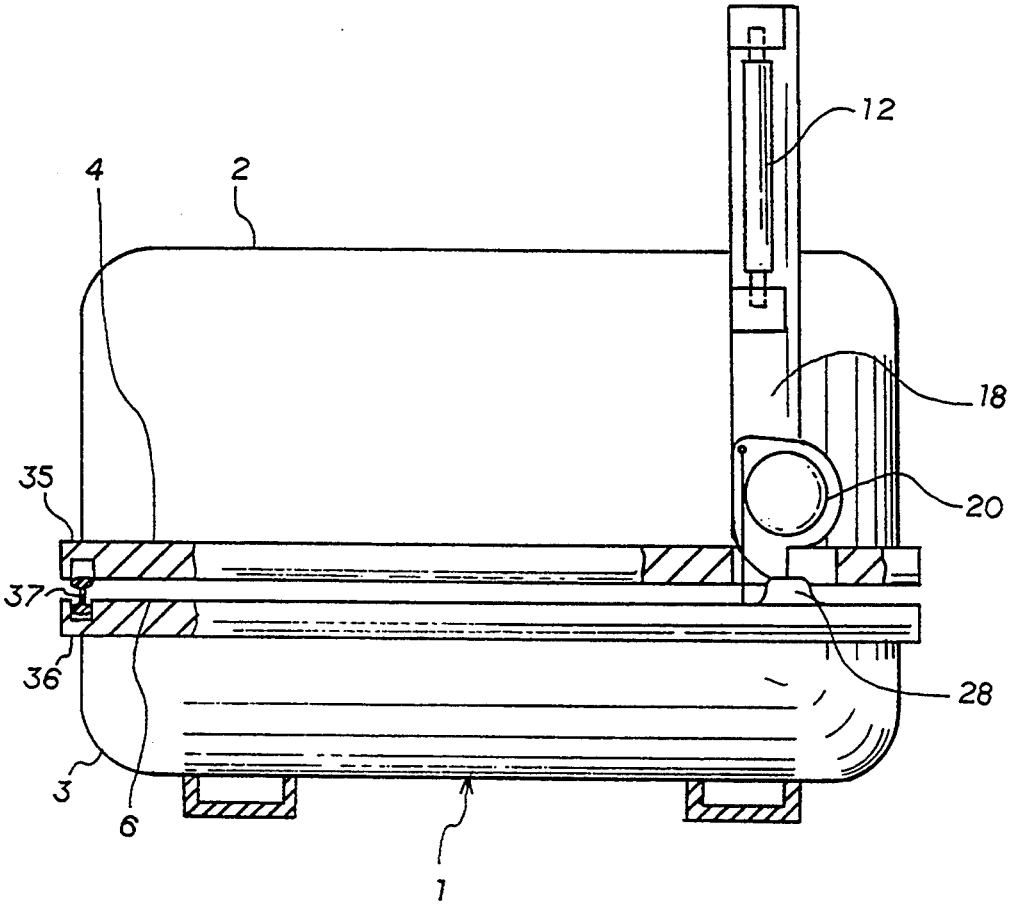
FIG. 2 is a partially sectional view showing the container according to FIG. 1 in the opened position.

FIG. 2 shows the container 1 in the open position. Identical components are designated by the same reference numerals as in FIG. 1. The transmission member 18 in FIG. 2 is pivoted by 90° in relation to the resting position according to FIG. 1, and the tumbler 12 is tilted vertically upward compared with FIG. 1.

The container shells 2, 3 are sealed against one another by a labyrinth seal 37 acting as a sealing member extending along the front surfaces 4, 6, and the labyrinth seal 37 is accommodated in a first groove 35 at the first front surface 4 and in a second groove 36 at the second front surface 6.

The labyrinth seal 37 has a double T-like profile cross section, and is held in the first groove 35 and the second groove 36 in a positive-locking manner. During the opening movement of the transmission member 18, the pressure applied by the cam plate 20 to the projection 28 pulls the sealing member 37 out of at least one of the grooves 35, 36. Sealing with the labyrinth seal 37 offers the advantage that the entire length of the grooves 35, 36 can be used as a sealing surface, and a possible warping of the front surfaces 4, 6 relative to one another does not affect the tightness of the container 1.

Figure 3:
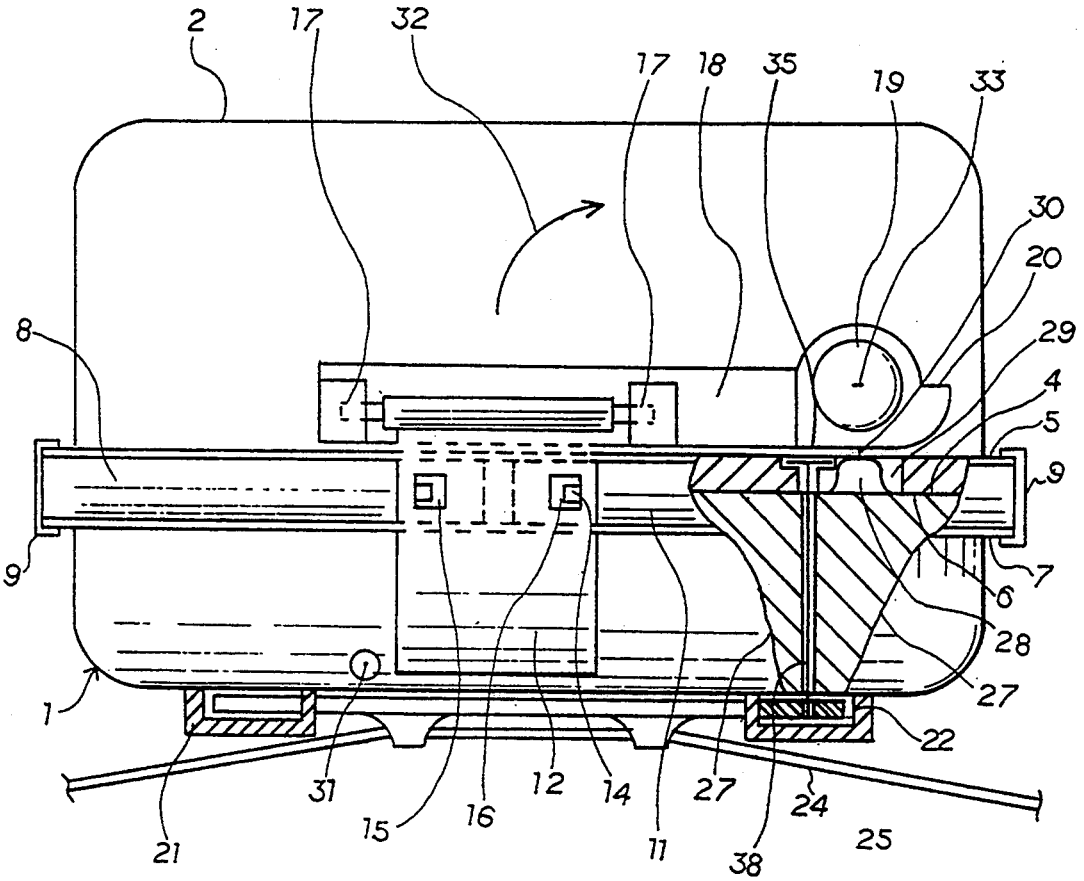
FIG. 3 is a partially sectional view showing an alternative embodiment to FIG. 1.

FIG. 3 shows an alternative embodiment of the fastening of the belt bracket 23. The difference from FIG. 1 is the fact that the first control pin is replaced with a second control pin 38, which is attached to the first container shell 2, and it releases the belt bracket 23 during the pivoting movement of the transmission member 18, during which the distance between the front surfaces 4, 6 is increased. Identical components are designated by the same reference numerals as in FIGS. 1 and 2.

While specific embodiments of the invention have been shown and described in detail to illustrate the application of the principles of the invention, it will be understood that the invention may be embodied otherwise without departing from such principles.

What is claimed is:

1. A container and locking device for gas tightly locking a container for gas masks and breathing equipment containing moisture-sensitive filter mass, comprising:

a first container shell and a second container shell, each container shell having outwardly projecting circumferential edges at front surfaces, said first container shell and said second container shell abutting at said front surfaces;

a strap having strap ends, surrounding said projecting circumferential edges to clamp said circumferential edges;

a sealing member connecting said first container shell and said second container shell, said sealing member being inserted into grooves located adjacent said front surfaces of said first container shell and said second container shell;

lock means for holding said strap ends, said lock means having a transmission member which is pivotable for pivoting movement around a transmission member hinge connected to one of said first container shell and said second container shell, said lock means including a tumbler connected to said strap ends in a closed position, said tumbler participating in said pivoting movement with said transmission member, said tumbler being connected to said transmission member via a tumbler hinge for moving from said closed position engaging said strap ends to a release position for releasing said strap ends upon pivoting movement of said tumbler about said tumbler hinge, said transmission member including camming means acting on said first container shell and said second container shell to move said first container shell and said second container shell relative to each other to increase a distance between said front surfaces upon pivoting movement of said transmission member.

2. A container and locking device according to claim 1, wherein:

said strap ends are provided with projecting dogs, said tumbler including windows for receiving said projecting dogs in said closed position of said tumbler.

3. A container and locking device according to claim 1, wherein:

said transmission member hinge is provided between said transmission member and said first container shell, said transmission member camming means having a cam plate adjacent said transmission member hinge, said cam plate engaging a projection connected to said second container shell.

4. A container and locking device according to claim 1, wherein:

one of said tumbler and said transmission member is provided with deflecting means for converting said pivoting movement into a translatory movement with a control pin for releasing a belt bracket located at said second container shell upon said pivoting movement of said one of said tumbler and transmission member.

5. A container and locking device according to claim 4, wherein:

said deflecting means provides and additional hinge, said additional hinge being attached to said transmission member with a lever arm spaced a distance from a center of said transmission member hinge.

6. A container and locking device according to claim 1, wherein:

said first container shell has a second control pin for releasing a belt bracket located at said second container shell upon said pivoting movement of said transmission member.

7. A container and locking device according to claim 1, wherein:

said sealing element is designed as a labyrinth seal.

* * * * *